US011333337B2

(12) United States Patent
Britt

(10) Patent No.: US 11,333,337 B2
(45) Date of Patent: May 17, 2022

(54) WIRING SYSTEM FOR GROUND MOUNTED LIGHTING FIXTURES

(71) Applicant: Paul E. Britt, Los Angeles, CA (US)

(72) Inventor: Paul E. Britt, Los Angeles, CA (US)

( * ) Notice: Subject to any disclaimer, the term of this patent is extended or adjusted under 35 U.S.C. 154(b) by 81 days.

(21) Appl. No.: 17/009,689

(22) Filed: Sep. 1, 2020

(65) Prior Publication Data

US 2022/0065430 A1 Mar. 3, 2022

(51) Int. Cl.

| | |
|---|---|
| ***F21V 23/00*** | (2015.01) |
| ***F21V 21/08*** | (2006.01) |
| ***F21V 17/12*** | (2006.01) |
| ***F21V 17/18*** | (2006.01) |
| ***F21V 23/06*** | (2006.01) |
| ***F21W 131/10*** | (2006.01) |
| ***F21S 8/08*** | (2006.01) |

(52) U.S. Cl.

CPC ..... *F21V 23/002* (2013.01); *F21V 17/12* (2013.01); *F21V 17/18* (2013.01); *F21V 21/0824* (2013.01); *F21V 23/06* (2013.01); *F21S 8/081* (2013.01); *F21W 2131/10* (2013.01)

(58) Field of Classification Search

CPC ..... F21S 8/081–083; F21V 23/002; F21V 23/06; F21V 21/0824

See application file for complete search history.

(56) References Cited

U.S. PATENT DOCUMENTS

| | | | | |
|---|---|---|---|---|
| 10,364,972 | B1 * | 7/2019 | Breedlove, Sr. | F21V 15/01 |
| 2008/0151545 | A1 * | 6/2008 | Kratz | F21V 21/0824 362/249.01 |
| 2009/0122564 | A1 * | 5/2009 | Beadle | F21V 21/0824 362/431 |
| 2018/0073709 | A1 * | 3/2018 | Enck, Sr. | F21V 21/06 |
| 2021/0352795 | A1 * | 11/2021 | Lu | H05B 47/115 |
| 2021/0356110 | A1 * | 11/2021 | Zhang | F21V 23/002 |

* cited by examiner

*Primary Examiner* — Mariceli Santiago

(74) *Attorney, Agent, or Firm* — Thomas A. Runk; Brooks Kushman P.C.

(57) ABSTRACT

A wiring system for ground mounted lighting fixtures comprises a base of the lighting fixture that is located on top of the ground surface. The above-ground base includes a wiring box and construction of the base resists sprinkler water and rain from entering the wiring box. A connector device is mounted in the wiring box and has multiple ports for interconnecting the wires of the incoming power cable with wires of the outgoing power cable and interconnecting those wires with the wires of the power cable of the light source in the fixture. The connector device includes an internal circuit that provides a parallel connection of the light source cable with the incoming and outgoing power cables. Spring lever clamps are used to secure the various wires in the connector device ports and in connection with the internal circuit. The wiring box is thus integral with the light fixture.

20 Claims, 7 Drawing Sheets

WIRING SYSTEM FOR GROUND MOUNTED LIGHTING FIXTURES

TECHNICAL FIELD

The invention relates generally to landscape illumination and more particularly, to a wiring system for ground mounted lighting fixtures.

BACKGROUND

The field of landscape illumination generally refers to night time lighting of landscapes for the purposes of enhancement, safety, aesthetics, accessibility, security, recreation, sports, social, and event uses. One common form of landscape illumination is yard and garden lighting. Yard and garden illumination generally refers to light fixtures strategically positioned to provide outdoor illumination of walkways, driveways, steps, private gardens, and other areas. Yard and garden illumination can consist of a long string of light fixtures located adjacent a walkway, for example, so as to provide enough light to see the walkway clearly, yet not be so close to the walkway as to be an obstacle. Light fixtures for yard and garden illumination may also be used to illuminate certain trees, walls, and fences. For the most part, yard and garden lighting fixtures are mounted in soil near the objects to be illuminated.

To secure individual light fixtures that provide yard and garden illumination in a selected position, the fixtures are often mounted in the soil with a spike that extends down far enough in the soil to provide the needed stability for the fixture. Each lighting fixture includes an illumination device, such as one or more light-emitting diodes (LEDs), that must receive electrical energy to function. In today's yard and garden illumination systems, electrical wiring is provided to each of the light fixtures by a single main power cable that is run near each light fixture in a narrow trench in the soil. Each light fixture includes a light source cable to be connected to a power cable. The light fixture cable is long enough to extend out of the light fixture and down into the soil to have its wires clamped or otherwise connected to the main power cable wires located in the trench in the soil. Once electrical connection is made with the main power cable in the soil, the trench is filled in with soil over the power cable, the light fixture cable, and the connections between the two. The connections and the cables are thus buried in the soil. The connections of the light fixture cable to the main power cable in the soil may take different forms. One common technique is to use a connector having connector halves that include sharp prongs. The installer pinches the connector halves together around the main power cable and the sharp prongs inside the connector halves pierce the wires of the main power cable to make electrical contact. The connectors are then pushed down into the trench in the soil approximately three to six inches deep and are covered over with soil. Then the installer moves to the next light fixture in the light string and connects it to the main power cable in the same manner.

The single main power cable is long enough to reach between the low-voltage transformer at the source of electricity and the last light fixture on the string of light fixtures.

There are different direct burial connectors or devices for interconnecting the light fixture wires to the main power wire in a parallel circuit; however, all are for underground use.

Wire connections made under ground are typically exposed to water and possibly fertilizer and other chemicals placed on the yard or garden material. Water and the other chemicals can quickly corrode the wires and the connections causing a loss of power transfer. Various techniques may be used to protect the wires from corroding, such as through the use of heat shrink tubing or other means of water proofing. Underground waterproof connector boxes are also available; however, they increase the cost and make it less convenient to install the light fixtures. This makes the task of connecting the lamps to the main power cable time consuming, expensive, and difficult. These connections can also become unstable because of corrosion.

Another disadvantage of the above method of connecting the individual lamps with the main power cable is that the sharp prongs may miss the wire inside the cable or may sever the wire. In any case, the prongs pierce the insulation over the main power cable which can allow water and chemicals from the soil to attack the copper conductors and the connections with the main power cable. When the main power cable becomes too corroded, the electrical conduction of power will cease thereby requiring excavation of the main power cable and repair. This is a serious shortcoming to the existing methods of interconnecting individual yard or garden light fixtures.

Hence those of skill in the art have recognized a need for an improved wiring system for ground mounted lighting fixtures. A need also exists for a more convenient system and method of the electrical connection process. The present invention fulfills these needs and others.

SUMMARY OF THE INVENTION

Briefly and in general terms, the present invention is directed to a wiring system for ground mounted lighting fixtures in which electrical connections are made internally above ground so that the connections avoid degradation by soil chemistry and water from sprinkler.

In particular, there is provided a wiring system for ground mounted lighting fixtures, the lighting fixtures including a light source mounted to a top of a light source support tube, the light source having light source power cable connected to the light source and running through the light source support tube, and a ground mounting spike, the wiring system comprising a base to which the light source support tube is mounted and to which the spike is mounted, the base having a flat base plate configured to rest on the ground surface and to which the spike is attached, the base also having a shell cover mounted to the base plate, the shell cover having a shape selected to form a wiring box within the base between the shell cover and the base plate, wherein an end of the light source power cable is located within the wiring box, whereby the base and wiring box are above ground and a connector device located in the wiring box to receive and interconnect power cable wires, the connector device having a plurality of connector ports, each connector port having a size selected to receive a wire from a power cable, the connector device including an internal electrical circuit that interconnects wires of an incoming power cable with wires of an outgoing power cable and further interconnects a first wire of the light source power cable with a selected wire of the incoming power cable and a second wire of the light source cable with a wire of the outgoing power cable to form a parallel circuit of the light source cable with the incoming and outgoing power cables, the connector device further having releasable mechanical clamps to hold each wire of the power cables in selected fixed positions in their respective ports of the connector device and the connector device electrical circuit, whereby, the connector device forms an integral part of the lighting fixture and locates its electrical circuit and its wire interconnections above ground.

In more detailed aspects, the flat base plate has a diameter selected to provide stabilization to the light fixture to resist tipping. The flat base plate has a threaded center hole and the spike has a threaded upper end whereby the spike and flat base plate are assembled in fixed relationship by mating the upper threaded end of the spike with the threaded hole of the flat base plate. The flat base plate has an opening that receives the incoming power cable from underground into the wiring box for connection to the connector device. The flat base plate has an opening that receives the outgoing power cable from underground into the wiring box for connection to the connector device.

In further aspects, the flat base plate has a first opening that receives the incoming power cable from underground into the wire box for connection to the connector device, and the flat base plate has a second opening that receives the outgoing power cable from underground into the wire box for connection to the connector device. The shell cover has a size selected to receive the flat base plate within it to surround the base plate thereby providing protection of the base plate and the connector device from rain and sprinkler water. The releasable mechanical clamps of the connector device include levers that, when moved in one direction, apply a clamping force to hold the respective wire in a fixed position in the port of the connector device, and when the lever is moved in a different direction, release the clamping force from the respective port thereby allowing easier mounting of a wire into the port and removal of a wire from the respective port.

In yet further aspects, the releasable mechanical clamps of the connector device include clamp springs that are controlled by the levers to force and secure wires into electrical contact with the circuit of the connector device and wherein the levers release the clamp springs to permit removal or mounting of the wires in the port. The shell cover includes a base light source lamp mounting tube on which the light source support tube is mounted. The light source support tube is slid over the base light source lamp mounting tube and a set screw is mounted through the light source support tube into contact with the base light source lamp mounting tube to mouth both together in a fixed position whereby water runs off the light source support tube onto the shell cover thereby resisting water entering the wiring box.

In a different aspect, the light source support tube is slid over the base light source lamp mounting tube and the light source support tube has an inner diameter and the base light source lamp mounting tube has an outer diameter, wherein the inner diameter and outer diameters are selected to result in a press fit between the mounting of the light source support tube onto the base light source lamp mounting tube to mount both together in a fixed position whereby water runs off the light source support tube onto the shell cover thereby resisting water entering the wiring box.

In particular method aspects of the invention, there is provided a method of wiring ground mounted lighting fixtures, the lighting fixtures including a light source mounted to a top of a light source support tube, the light source having light source power cable connected to the light source and running through the light source support tube, and a ground mounting spike, the method comprising assembling a base, comprising mounting a flat base plate configured to rest on the ground surface to a shell cover, the shell cover having a shape selected to form a wiring box between the shell cover and the base plate, wherein an end of the light source power cable is located within the wiring box, and attaching the spike to the flat base plate, mounting the base to the light source support tube whereby the base and wiring box are above ground, mounting a connector device in the wiring box, receiving and interconnecting power cable wires in a plurality of connector ports in the connector device, each connector port having a size selected to receive a wire from a power cable, the connector device including an internal electrical circuit that interconnects wires of an incoming power cable with wires of an outgoing power cable and further interconnects a first wire of the light source power cable with a selected wire of the incoming power cable and a second wire of the light source cable with a wire of the outgoing power cable to form a parallel circuit of the light source cable with the incoming and outgoing power cables, clamping the wires in the connector ports with releasable mechanical clamps to hold each wire of the power cables in selected fixed positions in respective ports of the connector device and in selected positions in the connector device electrical circuit, whereby, the connector device forms an integral part of the lighting fixture and locates its electrical circuit and its wire interconnections above ground.

In further method aspects, the step of assembling a base with a flat base plate further comprises assembling the base with a flat base plate that has a diameter selected to provide stabilization to the light fixture to resist tipping. The step of assembling a base with a flat base plate further comprises assembling the base with a flat base plate that has an opening receiving the incoming power cable from underground into the wiring box for connection to the connector device.

Yet further method aspects are directed to the step of clamping the wires in the connector ports with releasable mechanical clamps comprising controlling the clamping with levers that, when moved in one direction, apply a clamping force to hold the respective wire in a fixed position in the port of the connector device, and when the lever is moved in a different direction, releasing the clamping force from the respective port thereby allowing easier mounting of a wire into the port and removal of a wire from the respective port. The method of wiring ground mounted lighting fixtures of claim 19 wherein the step of clamping the wires in the connector ports with releasable mechanical clamps comprises clamping the wires using clamp springs that are controlled by the levers to force and secure wires into electrical contact with the circuit of the connector device and wherein the levers release the clamp springs and clamping force to permit easier mounting of the wires in the ports and removal of the wires from the ports.

The features and advantages of the invention will be more readily understood from the following detailed description that should be read in conjunction with the drawings.

DETAILED DESCRIPTION OF PREFERRED EMBODIMENTS

Figure 1:
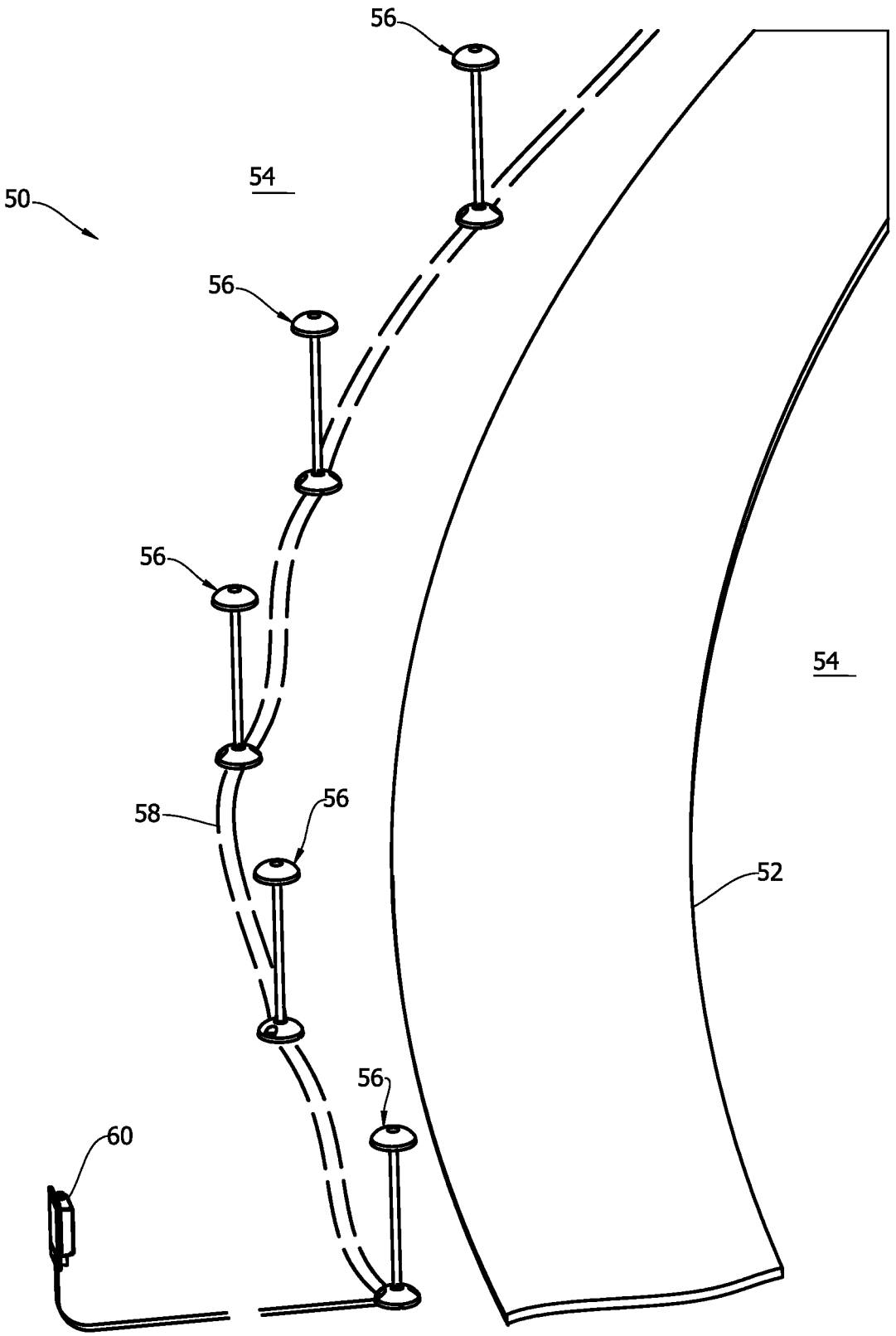
FIG. 1 is a perspective view of a landscape illumination system positioned adjacent a portion of a sidewalk which has been built in a grassy lawn. The landscape illumination system in this example comprises a series of lighting fixtures and associated wiring installed in relation to the sidewalk so as to provide illumination for users of the sidewalk, but far enough away so as to not be obstacles. A lighting system power source is also shown.

Referring now in more detail to the exemplary drawings in which like reference numerals designate corresponding or like elements among the several views, FIG. 1 is a perspective view of a landscape illumination system 50 positioned adjacent a portion of a sidewalk 52 which has been built in a grassy lawn 54. Under the grass exists common soil. The landscape illumination system in this example comprises a series of lighting fixtures, all of which are indicated by the reference numeral 56. The associated wiring 58 for powering the light fixtures is located below the ground surface of grass and in the soil, and accordingly, it is indicated as such with dashed lines. The power for the light fixtures is shown as box 60. The light fixtures are positioned in relation to the sidewalk so as to provide sufficient illumination for users of the sidewalk but are far enough away so as not to be obstacles to those walking on the sidewalk.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 2:
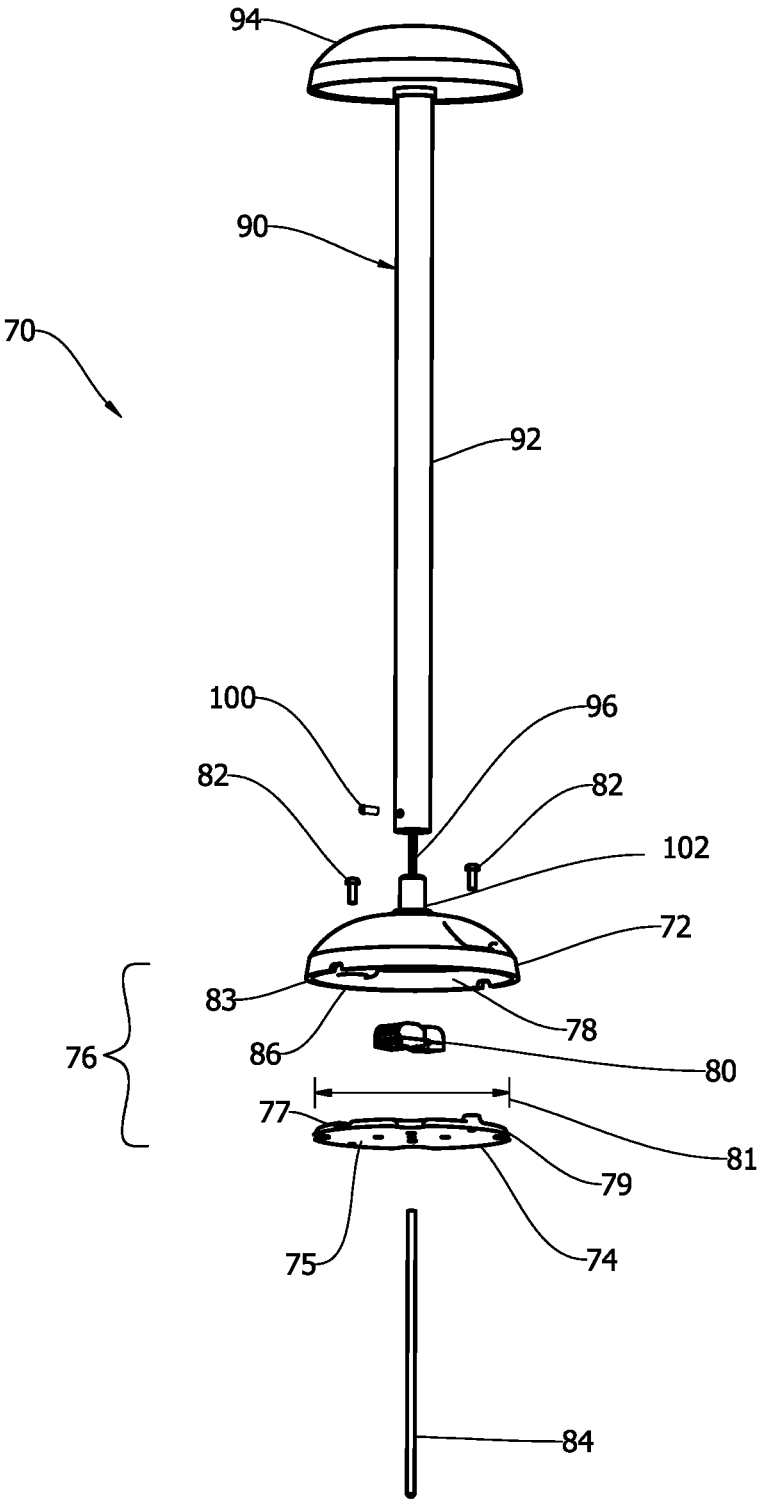
FIG. 2 is an exploded perspective view of a lighting fixture in which a wiring system in accordance with aspects of the invention will be used. In this view, the mechanical components and their relationships with each other are shown. The light fixture includes a mounting spike for being driven into a landscape material to hold the lighting fixture in a selected fixed position both horizontally and vertically.

Referring now to FIG. 2, an exploded view an exemplary light fixture 70 is provided. This figure presents the components of a light fixture in which the inventive wiring system for ground mounted lighting fixtures will be employed, as is shown in detail in subsequent figures. The light fixture of FIG. 2 includes a shell cover 72 and a base plate 74 which, when assembled together with screws 82, form a base 76 of the light fixture. As shown in the figure, the shell cover is dome-shaped and when assembled with the base plate, a wiring box 78 is formed between the two. The wiring box 78 is more clearly shown in FIG. 3. Located between the shell cover and the base plate in the wiring box is an electrical connector device 80, which is shown in subsequent drawings and described in subsequent text below. Although the shell cover and the base plate are attached to each other with screws 82 in the embodiment of FIG. 2, other arrangements may be used. It is important to note that the base plate has an external (bottom) surface 75, and internal (top) surface 77, and an outer edge 79 and that the diameter 81 of the base plate is such that it will fit within the inner diameter 83 of the shell cover at the larger open end 86 of the shell cover 72. This arrangement will resist the inflow of water from sprinklers or from other sources into the wiring box. A spike 84 screws into the base plate in this embodiment and will be forced into the ground to position the light fixture in a selected position on the ground.

A light source component 90 of the light fixture 70 comprises a light source tube 92 and a light source head 94. In this embodiment, the light source head includes a light source in which light emitting diodes (not shown) are used although other embodiments may use different sources of light. Electrical energy to power the light source in the lamp head is conducted through the hollow lamp tube by a lamp cable in this embodiment. Part of a lamp cable 96 that is used to power the light source is shown in FIG. 2.

The lamp component 90 of FIG. 2 fits on the shell cover 72 with a press fit or a set screw 100. In the embodiment shown, the shell cover 72 includes a lamp mounting tube 102 that has an outer diameter that is less than the inner diameter of the lamp tube 92. The lamp tube is slid down over the lamp mounting tube. The lamp tube has a threaded hole (not shown) formed radially through the lamp tube and the set screw 100 is screwed into that threaded hole. The set screw is turned until it makes contact with the lamp mounting tube inside the lamp tube to clamp the lamp mounting tube and the lamp tube firmly together, whereby the lamp component is locked in place on the base 76. Forming the mechanical connection between the lamp component and the base lamp mounting tube in this way assures that sprinkler water that may strike the lamp tube will roll off outside the base and will not be conducted into the base where the wiring is located.

In another embodiment, the lamp mounting tube may have a taper (not shown) such that the smaller diameter part of the lamp mounting tube caused by the taper has a diameter that fits into the lamp tube 90. However, the larger diameter part of the taper will interfere with the hollow portion of the lamp tube and create a press fit thereby locking the lamp tube and lamp connector tube firmly together. Such mechanical connections of two tubes are well known to those of skill in the art and no further details are provided here. It is important that whatever connection is used resists the flow of water into the base.

Figure 3:
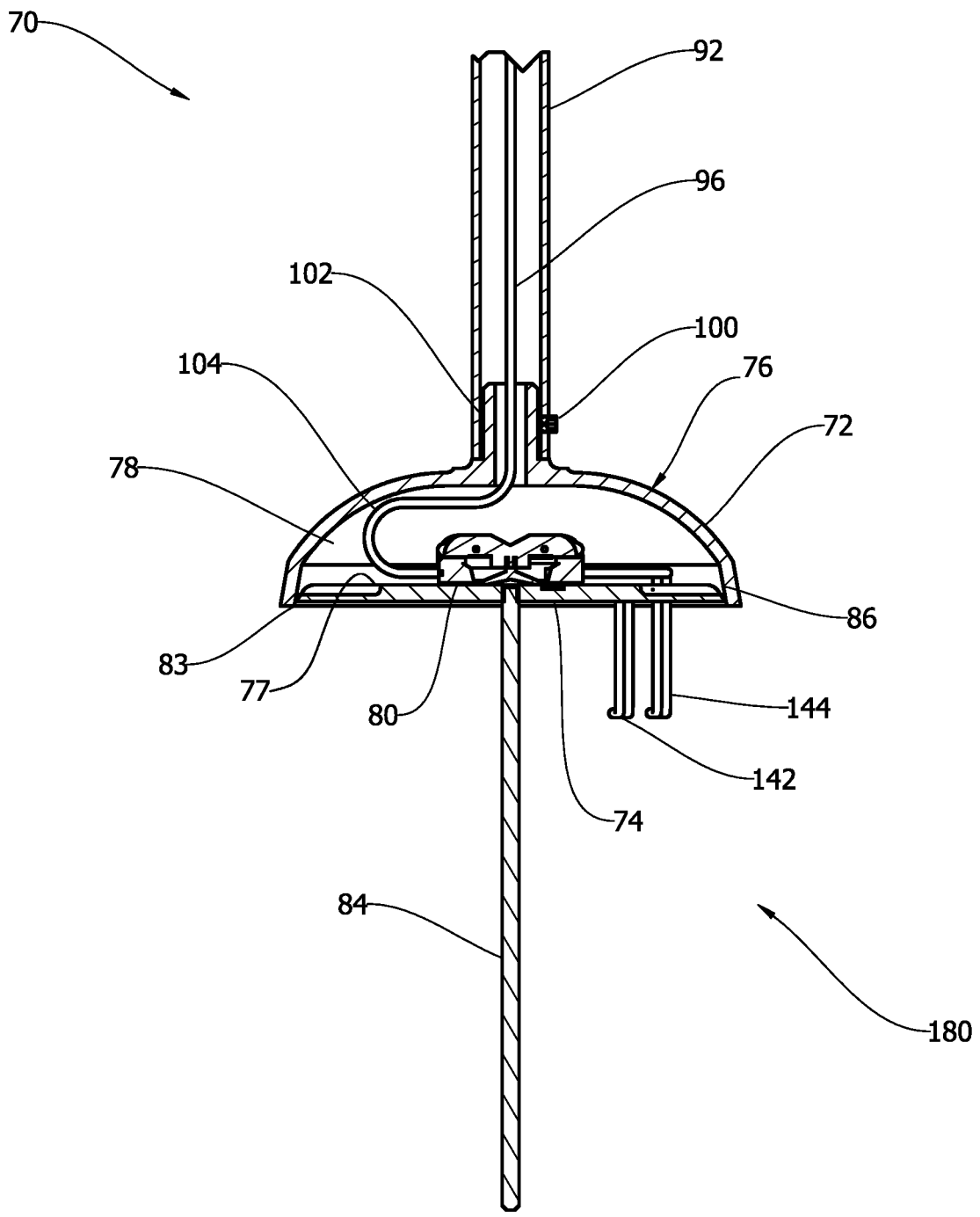
FIG. 3 is a cross-section side view of the base of the light fixture of FIG. 2 showing the shell cover, the base plate, the ground spike, the connector device, a portion of the lamp component tube, and internal wiring.

Turning now to FIG. 3, a cross-section side view of the assembled base 76 of the light fixture 70 of FIG. 2 is shown. The shell cover 72, the base plate 74, the ground spike 84, the wiring box 78, a connector device 80, and the lamp component tube 92 are shown assembled. The connector device 80 mounted in the wiring box 78 that was formed by the shell cover and the base plate is a three-wire connector in that it interconnects the incoming power cable, the outgoing power cable, and the lamp cable. A service loop 104 of the lamp cable 96 is also shown.

Different types of cable material may be used to run electrical power to the series of light fixtures of FIG. 1. Stranded wire is often used and 12/2, 14/2, 16/2, and 18/2 are widely available. It is often referred to as 12/2 black stranded low voltage landscape lighting wire and it may be purchased in various lengths, including five hundred feet, two hundred and fifty feet, and one hundred feet. The cable should be approved for direct underground burial. The conductors are typically made of bare copper annealed and stranded with a premium grade PVC jacket material. Stranded wires are often favored over solid wires because stranded wires provide more flexibility.

FIG. 3 does not show the screws 82 of FIG. 2 for the purpose of preserving clarity of the drawing of FIG. 3. The screws would normally be used in this embodiment to assemble and hold together the shell cover with the base plate.

The connector device 80 shown in FIG. 3 is located at the inner surface 77 of the base plate 74. In this embodiment, the connector device is not attached to the base plate but is resting on it or closely above it and is held in place by the stiffness of the six wires that are mounted and held within its ports (discussed below). In other embodiments, the connector device may be mounted to the inner surface of the base plate by means of silicon glue, or by a hardware fastener, such as a screw (not shown).

Figure 4:
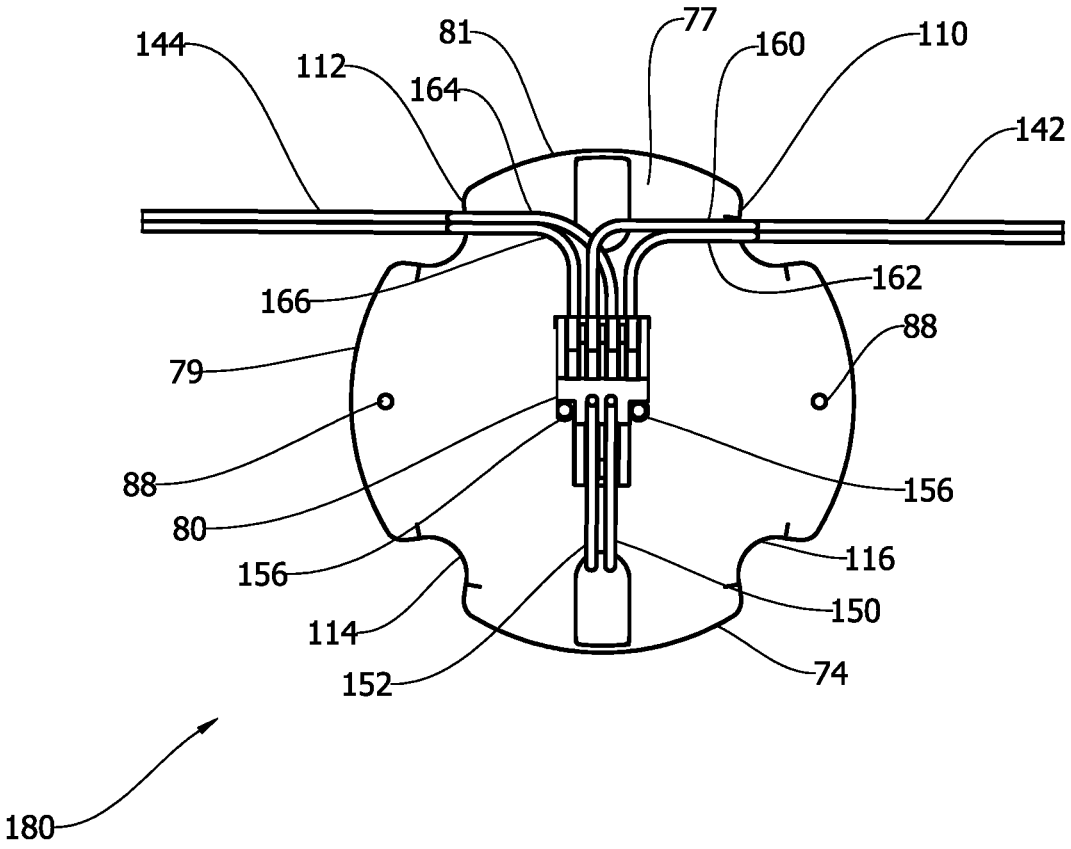
FIG. 4 is a top view of the bottom plate of the base of the light fixture of FIG. 2 showing the connector device and the wiring system of the light fixture in accordance with aspects of the invention.

FIG. 4 shows a top view of the base plate 74 with three cables interconnected together in a parallel configuration by the connector device 80. The incoming power cable 142 and outgoing power cable 144 are shown along with the two wires of each (160, 162, 164, and 166), but the lamp power cable 96 is not shown because it is at a ninety-degree angle to the paper. However, the two wires 150 and 152 of the lamp cable are shown. The two wires of each power cable are secured in the connector device. Levers and spring clips hold each wire mechanically in place in the connector device 80 as is shown in more detail in FIG. 5. Openings 110, 112, 114, and 116 are formed in the outer edge 79 of the base plate for receiving the incoming and outgoing power cables through the base plate and into the wiring box. In a different embodiment, there may be more or fewer openings in the base plate and they may be located at different positions.

Also located on the base plate 74 are two threaded holes 88 on either side of the connector device 90. These holes are used for assembly of the base plate with the shell cover 72 to form the base 76 (see FIG. 3). The two threaded holes are used to receive the threaded shafts of the two screws 82 shown in FIG. 2.

Figure 5:
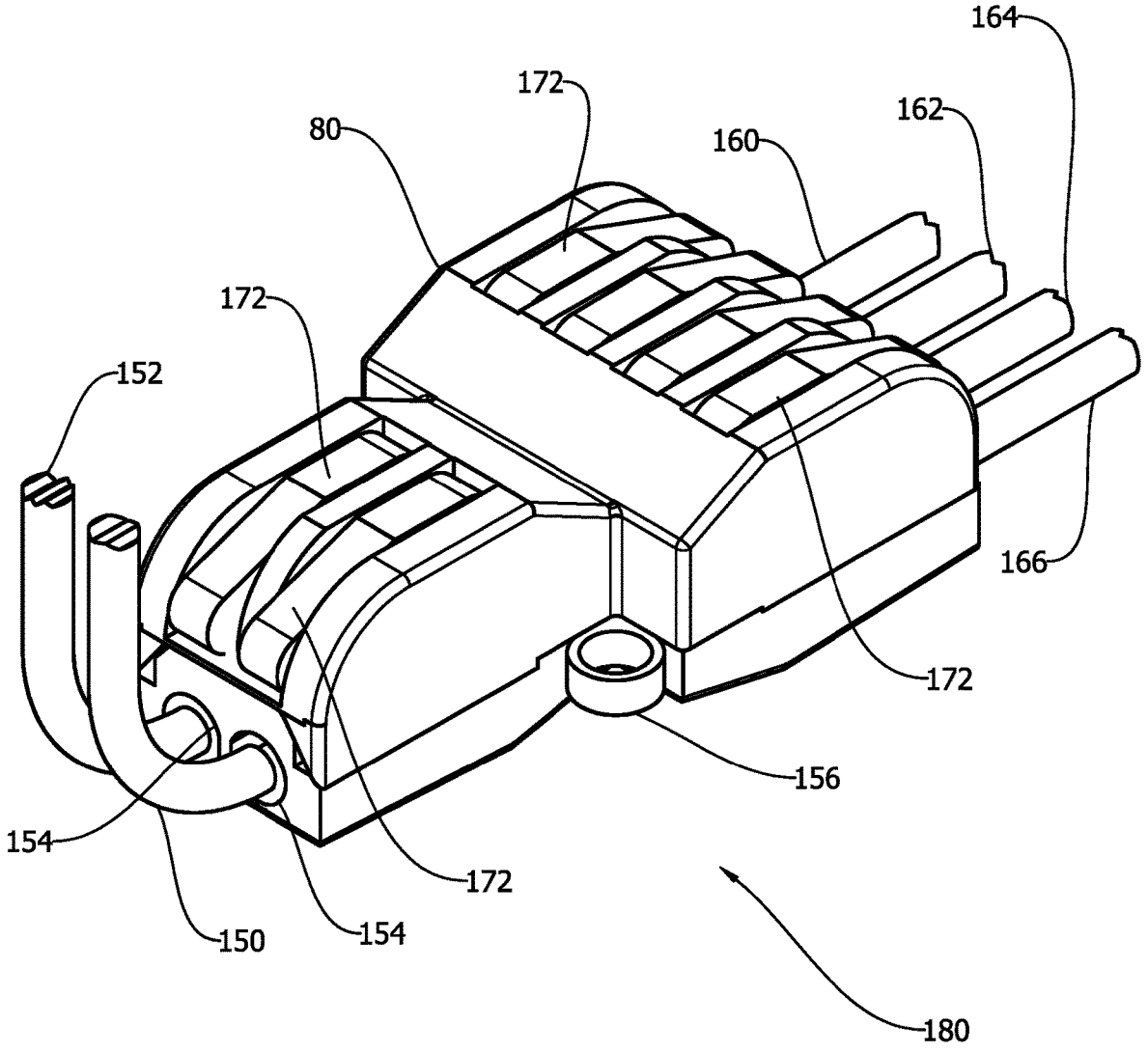
FIG. 5 is a perspective view of a connector device used in accordance with one aspect of the invention. The connector device provides a parallel connection circuit for powering the light source of the lamp component from incoming and outgoing power cables. The connector device has levers for each wire that force and secure the wire into mechanical and electrical contact with circuit conductors in the connector device to provide a robust wiring connector.
Figure 6:
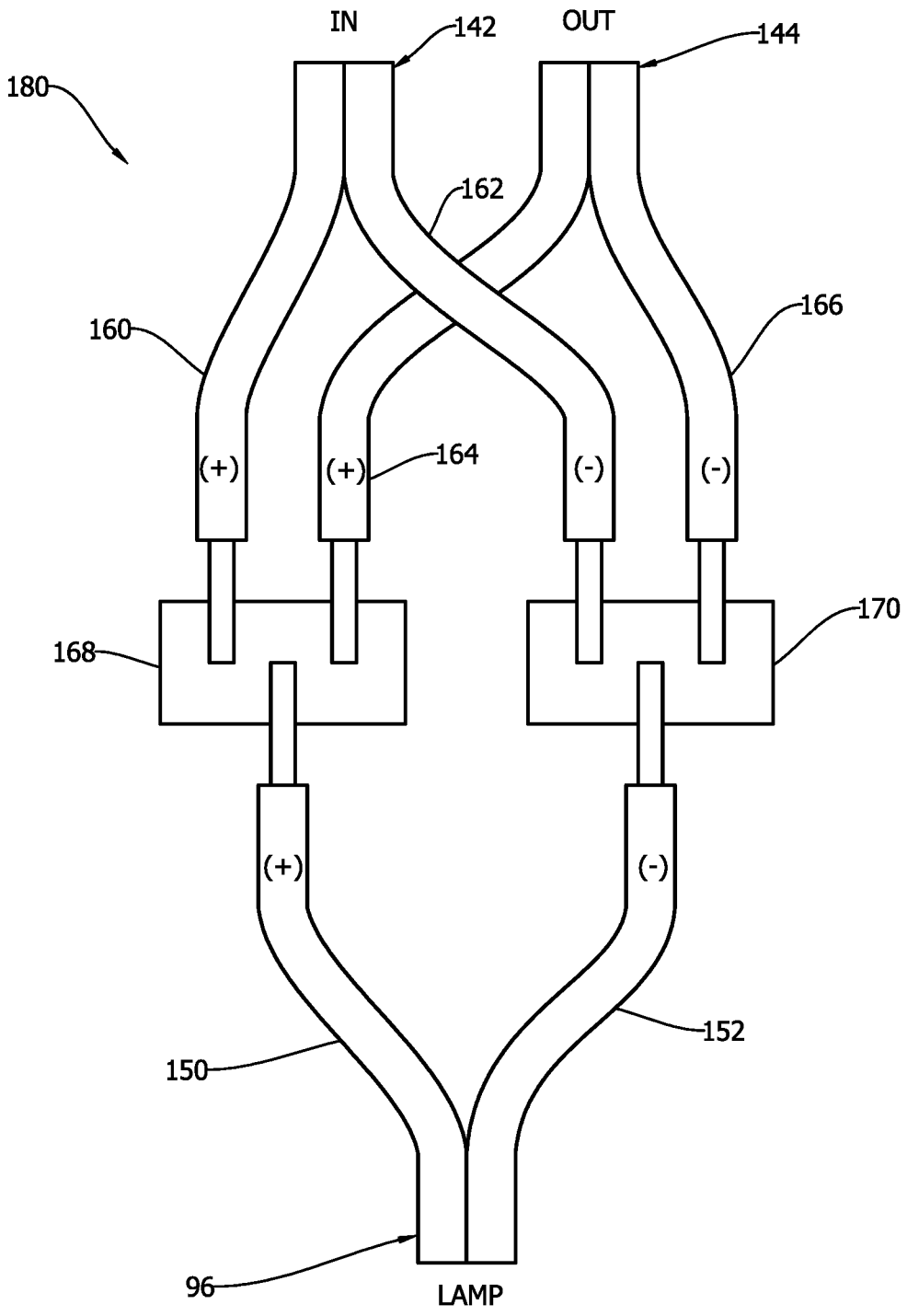
FIG. 6 is a block diagram of the internal electrical circuit of the connector device of FIGS. 2-5 showing how a parallel circuit is established with the incoming and outgoing power cable wiring.

FIG. 5 is a perspective view of an embodiment of a connector device 80 in accordance with aspects of the invention. The figure shows the six wires (150, 152, 160, 162, 164, and 166) of FIG. 4 mechanically secured in the connector device. These six wires are two-each from the three power cables, specifically, the lamp power cable 96, the incoming power cable 142, and the outgoing power cable 144 (see FIG. 6). Although not shown in FIG. 5, each of the wires has insulation stripped back about one-half inch. This is shown in FIG. 6. Each of the six wires is pushed into a respective connector device port 156, two of which are shown and labeled in FIG. 5. The connector device also includes six releasable levers 172 that lock an individual wire in place in the respective port and forces the electrical wire into contact with a respective part of an electrical circuit internal to the connector device. The circuit is shown in FIG. 6.

Only two levers are labeled with numeral 172 but all are meant to be labeled with that same reference numeral. Numeral 172 is not used in FIG. 5 with the other four levers to preserve the clarity of the drawing. Levers 172 are used to mechanically press the conductor of each of the six wires into contact with the appropriate part of the conductive circuit within the connector device when the lever is moved downwards into the connector device. The force exerted against the wire in the port also locks the wire in the port so that it is not easily removed. The levers are "releasable" because when they are pulled to rotate upwards, they release force against the wire and the wire can be withdrawn from the port. The lever mechanism in this embodiment also includes a spring to provide continuous pressure to the conductor to not only keep it in contact with the internal circuit of the connector device, but also the securely hold the conductor in the connector device when the lever in pressed down, as shown in FIG. 5.

Also shown in FIG. 5 is a connector device mounting sleeve 156. A screw or bolt or other fastener may be pushed through the sleeve and into a mounting surface, such as the base plate 74 (see FIG. 4) to hold the connector device 80 firmly to the mounting surface. In this embodiment, a second mounting sleeve is provide on the opposite side of the connector device (not shown).

FIG. 6 is a block diagram of the electrical circuit 180 of the connector device 80 of FIGS. 2-5 which is part of the wiring system for ground mounted lighting fixtures 180 in accordance with aspects of the invention. The figure shows one example of a circuit inside a three-cable connector device 80. The three cables that are connected are the incoming power cable 142, the outgoing power cable 144, and the lamp power cable 96. In this embodiment, each of these cables has two conductors. The positive electrical conducting strip 168 interconnects all positive conductors (power in (+), power out (+), and lamp power (+)) and the negative electrical conducting strip 170 interconnects all negative conductors (power in (−), power out (−), and lamp power (−)). This circuit 180 wiring provides a parallel circuit for the interconnection of the lamp conductors with the main power line. The conducting strips 168 and 170 may be formed of various materials including copper and stainless steel. In one embodiment, steel was selected because of the clamping force exerted against the conductors to hold them securely in the connector device 80. Steel was preferred because it is harder than copper.

Figure 7:
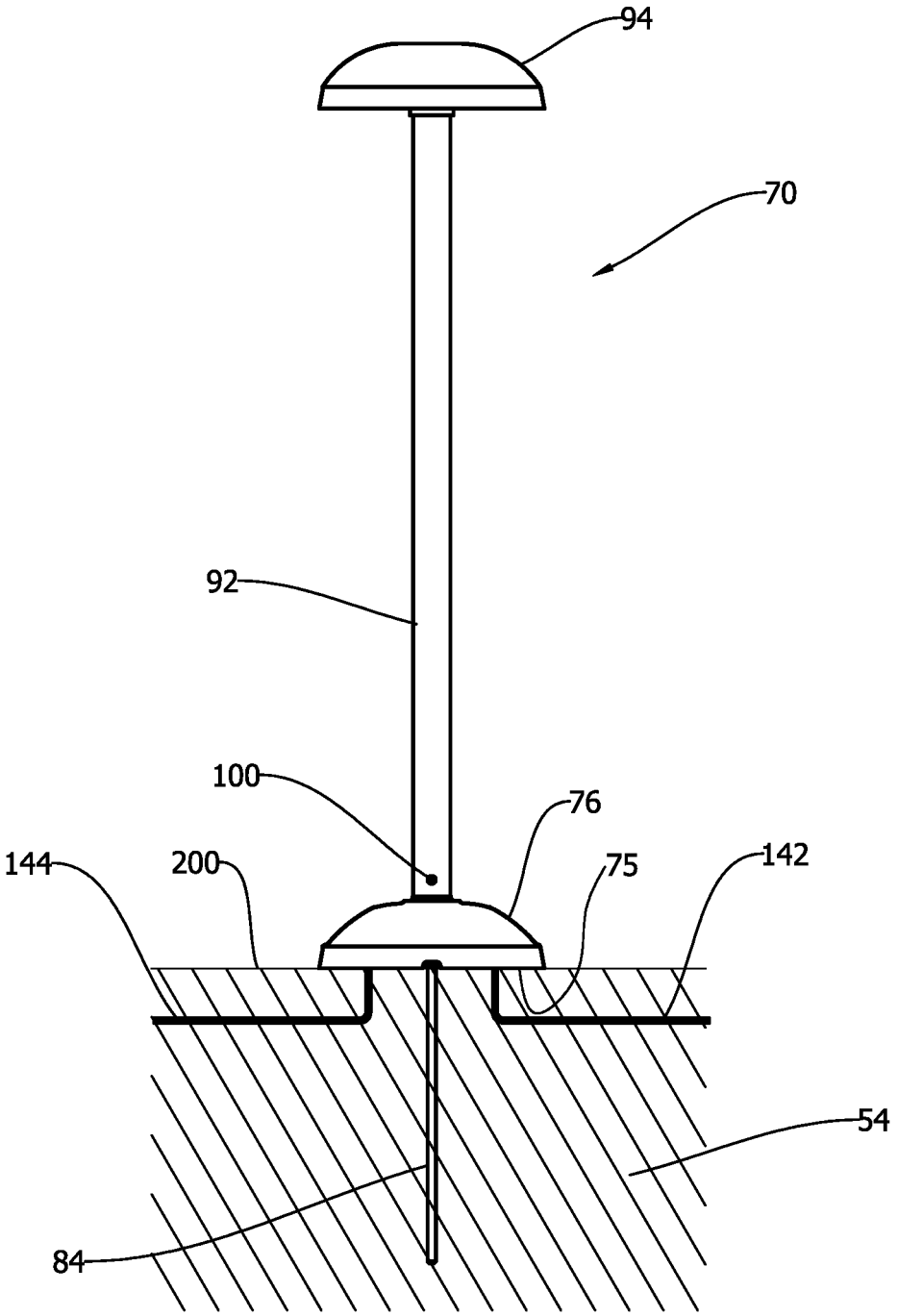
FIG. 7 is an elevation view of the assembled light fixture of FIG. 2 containing the wiring system for ground mounted lighting fixtures in accordance with aspects of the invention showing the light fixture fully mounted in the ground.

FIG. 7 is an elevation view of the assembled light fixture 70 of FIG. 2 actually mounted in soil 54. The light fixture contains the wiring system for ground mounted lighting fixtures of the invention. The light fixture 70 is fully and securely mounted in the ground 54 by its ground spike 84 and makes contact with the ground surface 200 by the bottom surface 75 of the base plate. The bottom surface 75 is flat for stability of the light fixture. The incoming power cable 142 and outgoing power cable 140, each buried in the soil 54, are shown and are located in a trench approximately six inches deep. The two power cables (incoming power cable and outgoing power cable) enter the light fixture through openings 110 and 112, respectively, (shown in FIG. 4) formed though the base plate 74 (also shown in FIG. 4).

Therefore, the wiring system for ground mounted lighting fixtures 180 has provided the ability to more easily, rapidly, and accurately wire each light fixture with the power cable by providing electrical connections above ground that are mechanically held in place securely inside the light fixture. The connections are easily made and released through the use of spring levers individually used for each wire of each cable. Because they are located above ground, the electrical and mechanical connections are protected from sprinklers and chemicals in the soil. If a light fixture fails and replacement is necessary, the wiring system in accordance with the invention allows for quick and easy replacement due to the wiring connections being located in the base 76 of the fixture. Such light fixture replacement may be required due to various reasons, one of which is physical damage to the fixture caused by a lawn mower, for example.

Unless the context requires otherwise, throughout the specification above and claims that follow, the word "comprise" and variations thereof, such as, "comprises" and "comprising" are to be construed in the normal patent law sense; i.e., an open, inclusive sense, which is as "including, but not limited to."

As required, a detailed embodiment of the present invention is disclosed herein; however, it is to be understood that the disclosed embodiment is merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

While the present invention has been described herein in terms of a certain preferred embodiment, those skilled in the art will recognize that modifications and improvements may be made without departing from the scope of the invention.

The exemplary embodiment described above is not intended to represent all possible forms of the invention. Rather, the words used in the specification are words of description of an embodiment, not limitations on the invention itself, and it is understood that various changes may be made to the embodiment without departing from the scope of the invention.

What is claimed is:

1. A wiring system for ground mounted lighting fixtures, the lighting fixtures including a light source mounted to a top of a light source support tube, the light source having light source power cable connected to the light source and running through the light source support tube, and a ground mounting spike, the wiring system comprising:

a base to which the light source support tube is mounted and to which the spike is mounted, the base having a flat base plate configured to rest on the ground surface and to which the spike is attached, the base also having a shell cover mounted to the base plate, the shell cover having a shape selected to form a wiring box within the base between the shell cover and the base plate, wherein an end of the light source power cable is located within the wiring box, whereby the base and wiring box are above ground; and a connector device located in the wiring box to receive and interconnect power cable wires, the connector device having a plurality of connector ports, each connector port having a size selected to receive a wire from a power cable, the connector device including an internal electrical circuit that interconnects wires of an incoming power cable with wires of an outgoing power cable and further interconnects a first wire of the light source power cable with selected wires of the incoming and outgoing power cables and interconnects a second wire of the light source cable with selected wires of the incoming and outgoing power cables to form a parallel circuit of the light source cable with the incoming and outgoing power cables, the connector device further having releasable mechanical clamps to hold each wire of the power cables in selected fixed positions in their respective ports of the connector device and the connector device electrical circuit;

whereby, the connector device forms an integral part of the lighting fixture and locates its electrical circuit and its wire interconnections above ground.

2. The wiring system for ground mounted lighting fixtures of claim 1 wherein the flat base plate has a diameter selected to provide stabilization to the light fixture to resist tipping.

3. The wiring system for ground mounted lighting fixtures of claim 1 wherein the flat base plate has a threaded center hole and the spike has a threaded upper end whereby the spike and flat base plate are assembled in fixed relationship by mating the upper threaded end of the spike with the threaded hole of the flat base plate.

4. The wiring system for ground mounted lighting fixtures of claim 1 wherein the flat base plate has an opening that receives the incoming power cable from underground into the wiring box for connection to the connector device.

5. The wiring system for ground mounted lighting fixtures of claim 1 wherein the flat base plate has an opening that receives the outgoing power cable from underground into the wiring box for connection to the connector device.

6. The wiring system for ground mounted lighting fixtures of claim 1 wherein the flat base plate has a first opening that receives the incoming power cable from underground into the wire box for connection to the connector device, and the flat base plate has a second opening that receives the outgoing power cable from underground into the wire box for connection to the connector device.

7. The wiring system for ground mounted lighting fixtures of claim 1 wherein the shell cover has a size selected to receive the flat base plate within it to surround the base plate thereby providing protection of the base plate and the connector device from rain and sprinkler water.

8. The wiring system for ground mounted lighting fixtures of claim 1 wherein the releasable mechanical clamps of the connector device include levers that, when moved in one direction, apply a clamping force to hold the respective wire in a fixed position in the port of the connector device, and when the lever is moved in a different direction, release the clamping force from the respective port thereby allowing easier mounting of a wire into the port and removal of a wire from the respective port.

9. The wiring system for ground mounted lighting fixtures of claim 1 wherein the releasable mechanical clamps of the connector device include clamp springs that are controlled by the levers to force and secure wires into electrical contact with the circuit of the connector device and wherein the levers release the clamp springs to permit removal or mounting of the wires in the port; and wherein the connector device interconnects three two-wire cables in parallel.

10. The wiring system for ground mounted lighting fixtures of claim 1 wherein the shell cover includes a base light source lamp mounting tube on which the light source support tube is mounted.

11. The wiring system for ground mounted lighting fixtures of claim on 10 wherein the light source support tube is slid over the base light source lamp mounting tube and a set screw is mounted through the light source support tube into contact with the base light source lamp mounting tube to mouth both together in a fixed position whereby water runs off the light source support tube onto the shell cover thereby resisting water entering the wiring box.

12. The wiring system for ground mounted lighting fixtures of claim on 10 wherein the light source support tube is slid over the base light source lamp mounting tube and the light source support tube has an inner diameter and the base light source lamp mounting tube has an outer diameter, wherein the inner diameter and outer diameters are selected to result in a press fit between the mounting of the light source support tube onto the base light source lamp mounting tube to mount both together in a fixed position whereby water runs off the light source support tube onto the shell cover thereby resisting water entering the wiring box.

13. A wiring system for ground mounted lighting fixtures, the lighting fixtures including a light source mounted to a top of a light source support tube, the light source having light source power cable connected to the light source and running through the light source support tube, and a ground mounting spike, the wiring system comprising:

a base to which the light source support tube is mounted and to which the spike is mounted, the base having a flat base plate configured to rest on the ground surface and to which the spike is attached, the base also having a shell cover mounted to the base plate, the shell cover having a shape selected to form a wiring box within the base between the shell cover and the base plate, wherein an end of the light source power cable is located within the wiring box, whereby the base and wiring box are above ground;

wherein the flat base plate has an opening that receives the incoming power cable from underground into the wiring box for connection to the connector device; and a connector device located in the wiring box to receive and interconnect power cable wires, the connector device having a plurality of connector ports, each connector port having a size selected to receive a wire from a power cable, the connector device including an internal electrical circuit that interconnects wires of an incoming power cable with wires of an outgoing power cable and further interconnects a first wire of the light source power cable with selected wires of the incoming and outgoing power cables and interconnects a second wire of the light source cable with selected wires of the incoming and outgoing power cables to form a parallel circuit of the light source cable with the incoming and outgoing power cables, the connector device further having releasable mechanical clamps to hold each wire of the power cables in selected fixed positions in their respective ports of the connector device and in electrical connection with the connector device electrical circuit;

wherein the releasable mechanical clamps of the connector device include levers that, when moved in one direction, apply a clamping force to hold the respective wire in a fixed position in the port of the connector device and in electrical connection with the circuit, and when the lever is moved in a different direction, release clamping force from the respective port thereby allowing easier mounting of a wire into the port and removal of a wire from the port;

wherein the connector device interconnects three two-wire cables in parallel;

whereby, the connector device forms an integral part of the lighting fixture and locates its electrical circuit and its wire interconnections above ground.

14. The wiring system for ground mounted lighting fixtures of claim 13 wherein the shell cover includes a base light source lamp mounting tube on which the light source support tube is mounted.

15. The wiring system for ground mounted lighting fixtures of claim on 14 wherein the light source support tube is slid over the base light source lamp mounting tube and a set screw is mounted through the light source support tube into contact with the base light source lamp mounting tube to mouth both together in a fixed position whereby water runs off the light source support tube onto the shell cover thereby resisting water entering the wiring box.

16. A method of wiring ground mounted lighting fixtures, the lighting fixtures including a light source mounted to a top of a light source support tube, the light source having light source power cable connected to the light source and running through the light source support tube, and a ground mounting spike, the method comprising:

assembling a base, comprising mounting a flat base plate configured to rest on the ground surface to a shell cover, the shell cover having a shape selected to form a wiring box between the shell cover and the base plate, wherein an end of the light source power cable is located within the wiring box, and attaching the spike to the flat base plate;

mounting the base to the light source support tube whereby the base and wiring box are above ground;

mounting a connector device in the wiring box;

receiving and interconnecting power cable wires in a plurality of connector ports in the connector device, each connector port having a size selected to receive a wire from a power cable, the connector device including an internal electrical circuit that interconnects wires of an incoming power cable with wires of an outgoing power cable and further interconnects a first wire of the light source power cable with a selected wire of the incoming power cable and a second wire of the light source cable with a wire of the outgoing power cable to form a parallel circuit of the light source cable with the incoming and outgoing power cables;

clamping the wires in the connector ports with releasable mechanical clamps to hold each wire of the power cables in selected fixed positions in respective ports of the connector device and in selected positions in the connector device electrical circuit;

whereby, the connector device forms an integral part of the lighting fixture and locates its electrical circuit and its wire interconnections above ground.

17. The method of wiring ground mounted lighting fixtures of claim 16 wherein the step of assembling a base with a flat base plate further comprises assembling the base with a flat base plate that has a diameter selected to provide stabilization to the light fixture to resist tipping.

18. The method of wiring ground mounted lighting fixtures of claim 16 wherein the step of assembling a base with a flat base plate further comprises assembling the base with a flat base plate that has an opening receiving the incoming power cable from underground into the wiring box for connection to the connector device.

19. The method of wiring ground mounted lighting fixtures of claim 16 wherein the step of clamping the wires in the connector ports with releasable mechanical clamps comprises controlling the clamping with levers that, when moved in one direction, apply a clamping force to hold the respective wire in a fixed position in the port of the connector device, and when the lever is moved in a different direction, releasing the clamping force from the respective port thereby allowing easier mounting of a wire into the port and removal of a wire from the respective port.

20. The method of wiring ground mounted lighting fixtures of claim 19 wherein the step of clamping the wires in the connector ports with releasable mechanical clamps comprises clamping the wires using clamp springs that are controlled by the levers to force and secure wires into electrical contact with the circuit of the connector device and wherein the levers release the clamp springs and clamping force to permit easier mounting of the wires in the ports and removal of the wires from the ports; and wherein the step of clamping the wires in the connector ports interconnects three two-wire cables in parallel.

* * * * *